US005974296A

United States Patent [19]

Suketomo et al.

[11] Patent Number: 5,974,296

[45] **Date of Patent: *Oct. 26, 1999**

[54] FIXING DEVICE HAVING PLURAL TRIGGER ELECTRODES

[75] Inventors: Seiji Suketomo; Junji Wakihara, both of Kato-gun, Japan

[73] Assignee: Fujitsu Limited, Kawasaki, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/919,214

[22] Filed: Aug. 28, 1997

[30] Foreign Application Priority Data

Mar. 19, 1997 [JP] Japan ..... 9-066280

[51] Int. Cl.[6] ..... G03G 15/20

[52] U.S. Cl. ..... 399/336; 399/98; 399/327

[58] Field of Search ..... 399/335, 98, 320, 399/327, 336, 337; 219/216

[56] References Cited

FOREIGN PATENT DOCUMENTS

| | | |
|---|---|---|
| 43 39 338 A1 | 1/1994 | Germany . |
| 2-272593 | 11/1990 | Japan . |
| 7-13457 | 1/1995 | Japan . |

*Primary Examiner*—Arthur T. Grimley
*Assistant Examiner*—Quana Grainger
*Attorney, Agent, or Firm*—Armstrong, Westerman, Hattori, McLeland & Naughton

[57] ABSTRACT

A fixing device is provided wherein a plurality of trigger electrodes are disposed in a circumferential direction of a flash lamp tube so that an ion can be generated over a broad area around the trigger electrodes so as to largely restrict sticking of toner to a translucent window.

17 Claims, 12 Drawing Sheets

FIXING DEVICE HAVING PLURAL TRIGGER ELECTRODES

BACKGROUND OF THE INVENTION

The present invention relates to a stain-free fixing device for use in an electrophotographic printer.

Nowadays, high-speed electrophotographic printers are becoming common. The high-speed printing, however, increases the speed of consumption of toner and paper which incessantly stains the glass window of a fixing device with dispersed unfixed toner. The incessant staining overtakes regular maintenance services. Therefore, the industry strongly depends on maintenance-free fixing devices so as to reduce the maintenance toil and cost.

In order to prevent the staining of glass windows in the electrophotography, the following methods have been proposed:

1) A method of removing air containing unfixed toner by suction through a sucking device;
2) A method of enabling unfixed toner to repel the glass window by applying direct current (DC) voltage to two electrodes embedded in the glass window so that the surface of the glass window facing the paper is charged with electric charge equal in polarity to the electric charge of the toner (Japanese Patent Application Laid-Open No. 2-272593 (1990)).
3) A method of enabling unfixed toner to repel the glass window by disposing a trigger electrode closest to the glass window and charging the surface of the glass window facing the paper with equal polarity to the polarity of the toner (Japanese Patent Application Laid-Open No. 7-13457 (1995)).

However, method 1) is not effective to remove unfixed toner with suction only, because of the short distance between the paper and glass face, thus necessitating the continued cleaning of the glass window.

The method 2) requires the provision of a special glass window allowing an electrode to be embedded therein, and an extra power source for impressing direct current (DC) voltage across the electrode, thereby increasing the production cost and a complicating the maintenance.

The method 3) encounters a problem that the toner repelling force is weakened in the course of using the fixing device, owing to the fact that the flash lamp thermally affects the trigger electrodes. In addition, because of the high tension applied to them, the trigger electrodes themselves generate a large amount of heat. In this way, the trigger electrodes tend to deform or crook due to heat over a long period of use. The deformation causes the trigger electrodes to displace, even partially, in a longitudinal direction from the original position adequately set with respect to the glass window. Thus, the method 3) does not provide a solution to the frequent maintenance, because the heat involved in this method requires regular maintenance when the fixing device is used for a long time.

BRIEF SUMMARY OF THE INVENTION

The present invention has been made with the aim of solving the above-described problems, and it is one object of the present invention to provide a fixing device which preserves its stain preventing effect of a glass window over along term, and which enables high quality printing without the necessity of periodical cleaning of the glass window over a long term.

The fixing device of the present invention is characterized in that it comprises: a flash lamp tube; a translucent window, disposed in an opposing position to the flash lamp tube, and at which side opposite to the flash lamp tube, a recording medium, adhering toner thereon, passes through; and a plurality of trigger electrodes, disposed in a circumferential direction on a periphery of the flash lamp tube which extends in a longitudinal direction.

Therefore, an ion is generated over a broad area around the trigger electrodes such that toner can be prevented from sticking to the translucent window (e.g., a glass window) over a broad area. Further, even if the trigger electrodes are deformed, the range in which the ion is generated covers a broad area of the translucent window.

The fixing device of the present invention is characterized in that the plurality of electrodes include: a reference trigger electrode disposed at a position at which it is closest to the translucent window; and a plurality of auxiliary trigger electrodes disposed symmetrically to each other in a circumferential direction of the flash lamp tube with the reference trigger electrode being a center.

Further, the fixing device of the present invention is characterized in that three trigger electrodes are provided and the auxiliary trigger electrodes are disposed at angles of substantially ±90° with respect to the reference trigger electrode.

Thus, an ion is generated over a broad area, with the center being the central portion of the translucent window, so that toner can be prevented from sticking.

The fixing device of the present invention is characterized in that it further comprises: a supporting member, having heat resistance and insulation, for supporting the trigger electrodes to the flash lamp tube, wherein the supporting member is disposed at an arbitrary position in a longitudinal direction of the flash lamp tube so as to enclose the flash lamp tube from peripheries of the trigger electrodes.

Thus, even if the supporting member, such as a supporting ring, is deformed, contact of the supporting member with other members or abnormal electric discharge, etc. can be prevented.

The fixing device of the present invention is characterized in that it further comprises: a connecting wire for electrically connecting the trigger electrodes with one another; and a trigger lead wire for supplying electricity to the trigger electrodes, wherein the trigger lead wire is connected to a connecting point between the reference trigger electrode and the connecting wire.

Thus, since the supply of electricity to the trigger electrodes is executed from the connecting point on the reference trigger electrode, the side of the flash lamp tube facing the recording medium is allowed to quickly and strongly emit light so that good thermal efficiency of fixing can be realized.

The above and further objects and features of the present invention will become more fully apparent from the following detailed description with the accompanying drawing figures.

BRIEF DESCRIPTION OF DRAWING FIGURES

Figure 11A:
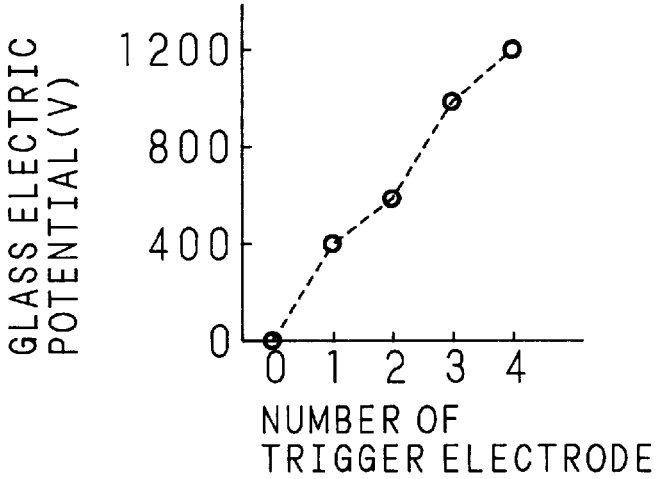
Figure 11B:
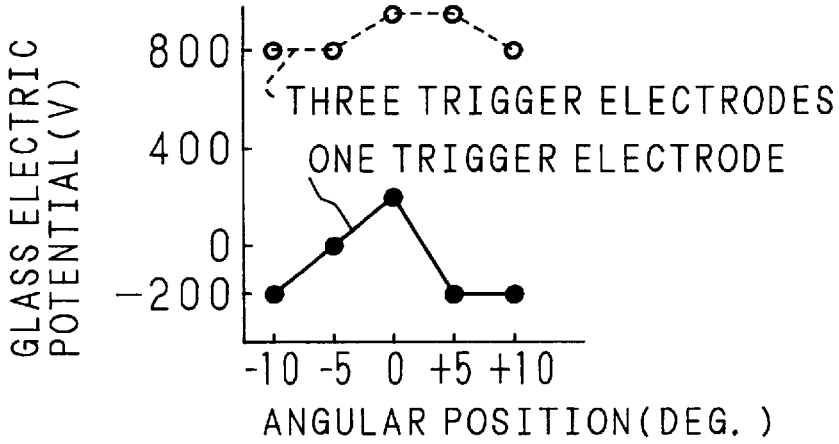
Figure 11C:
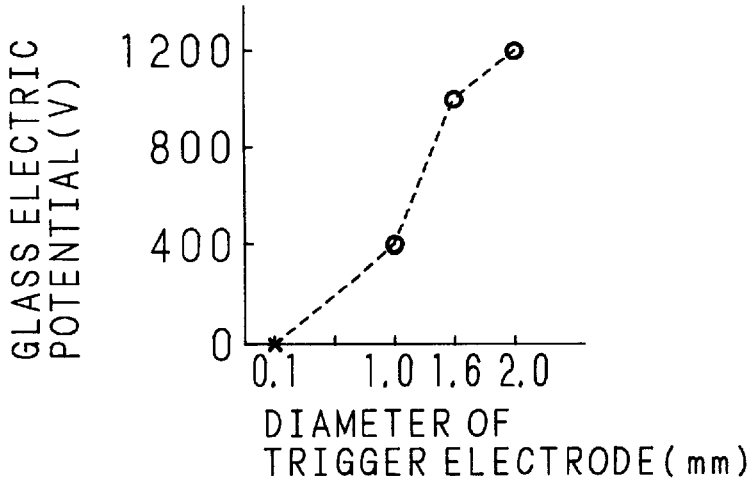
Figure 12A:
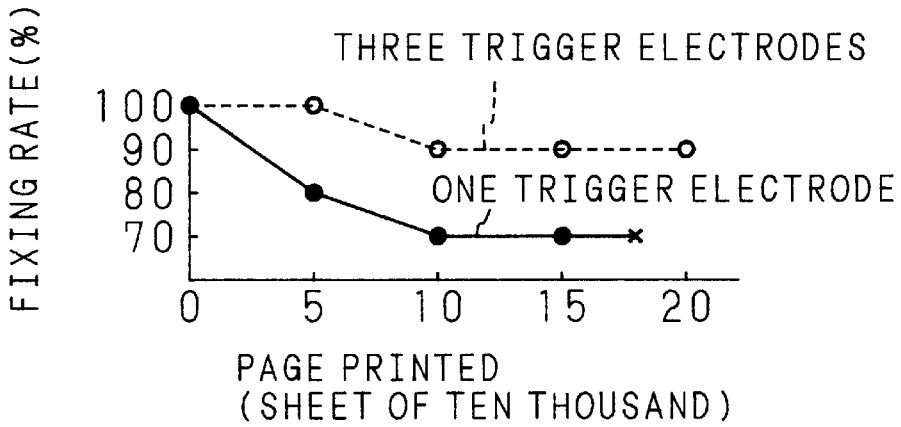
Figure 12B:
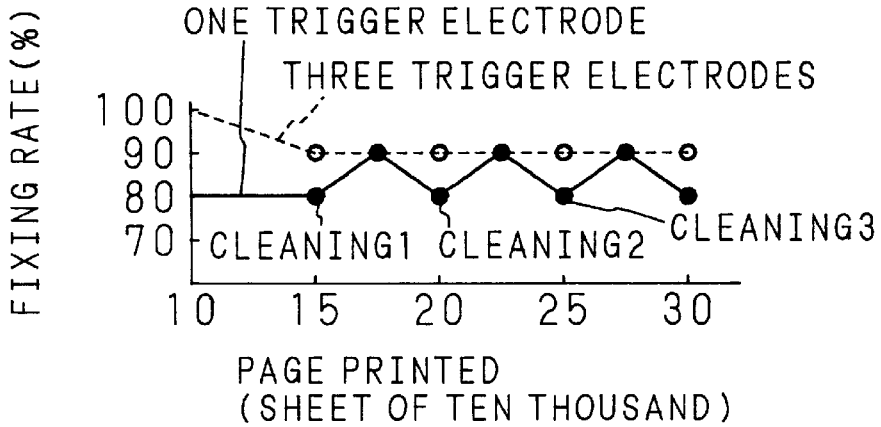
Figure 12C:
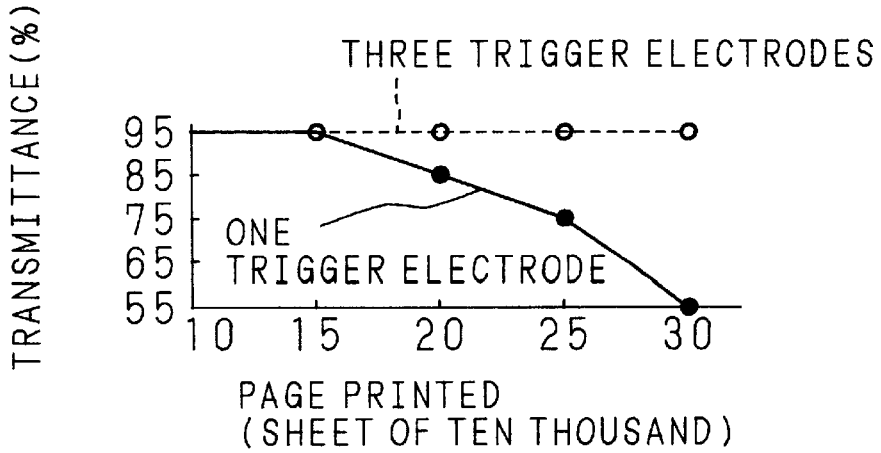

FIGS. 11A, 11B, and 11C are graphs showing test results supporting the operation and effect of the fixing device; and FIGS. 12A, 12B and 12C are graphs showing other test results supporting the operation and effect of the fixing device.

DETAILED DESCRIPTION OF THE INVENTION

Now the present invention will be described in detail with reference to the drawing figures showing one embodiment of the present invention.

Figure 1:
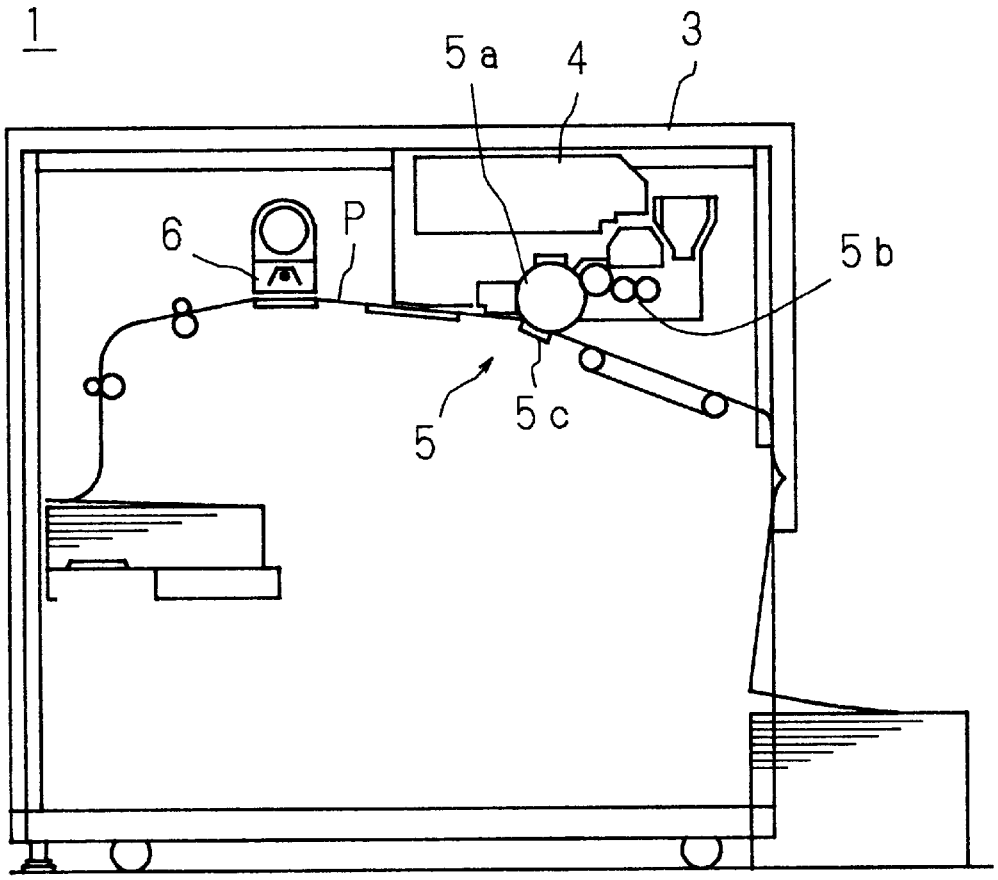
FIG. 1 is a cross-sectional view showing the outline constitution of a printing device of the present invention.
Figure 2:
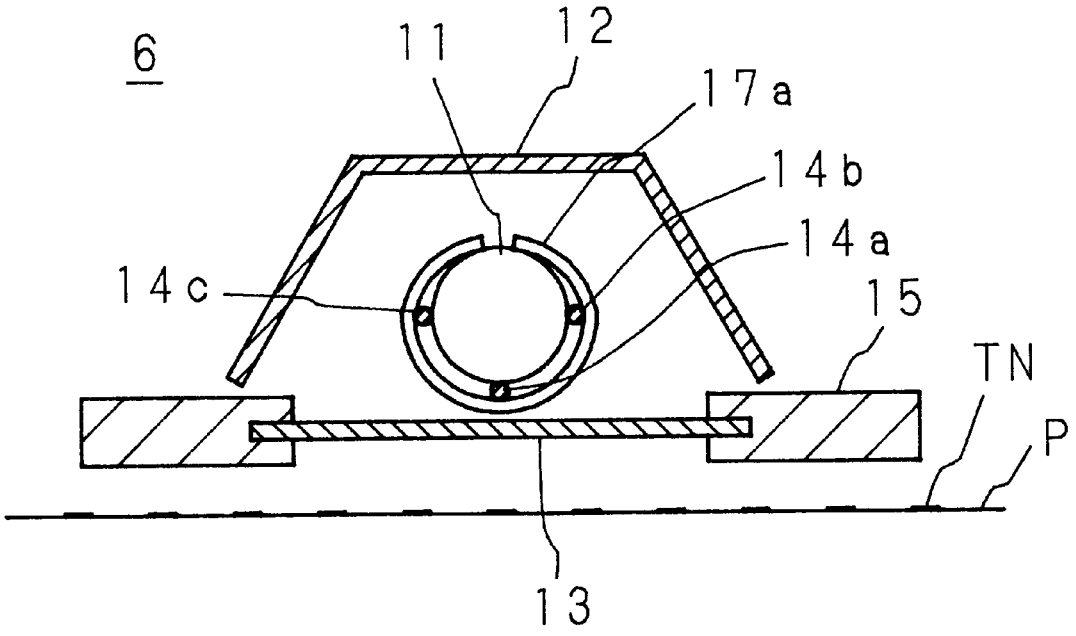
FIG. 2 is a cross-sectional view showing the constitution of a fixing device of the present invention.
Figure 3:
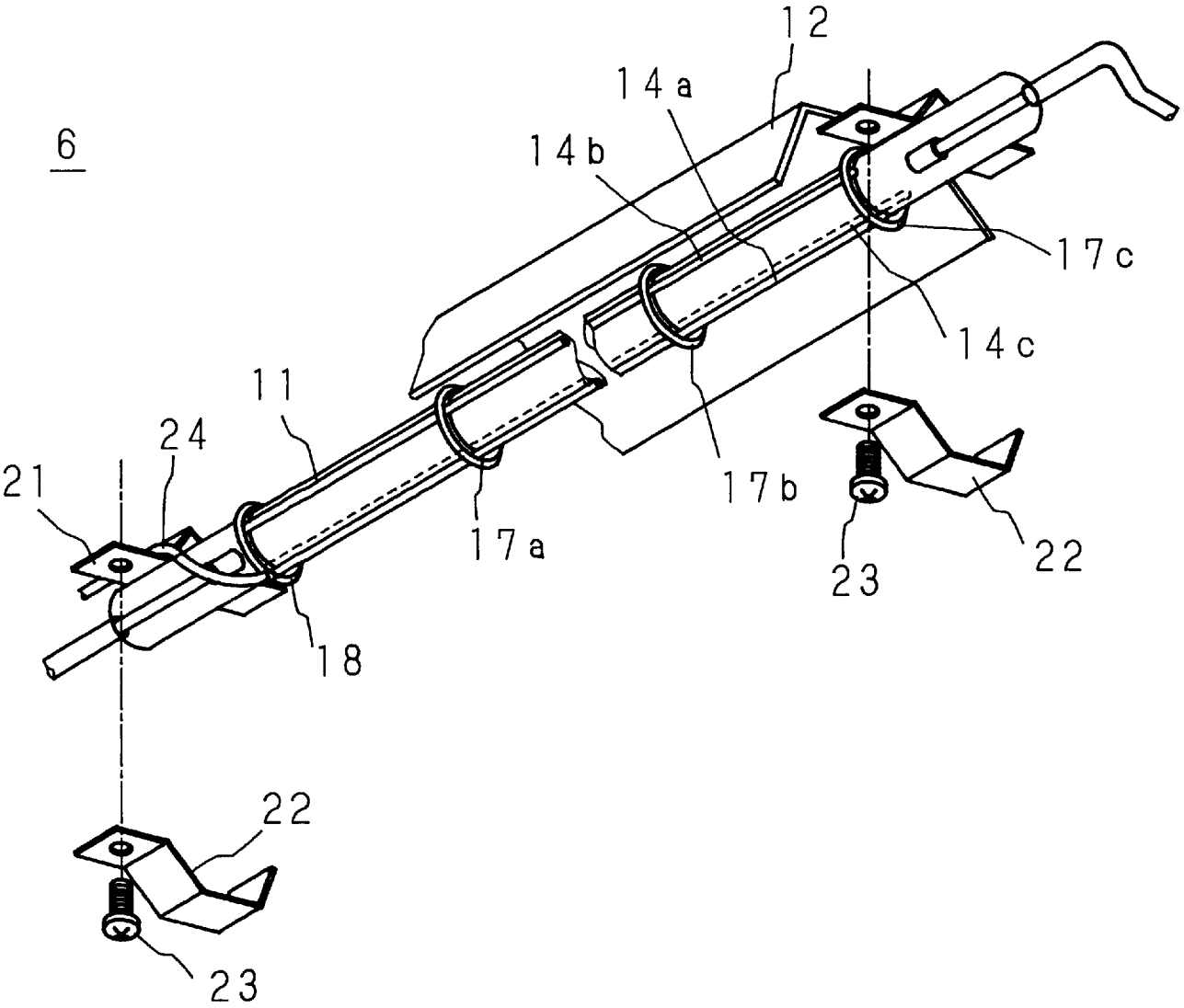
FIG. 3 is a perspective view of a flash lamp.
Figure 4:
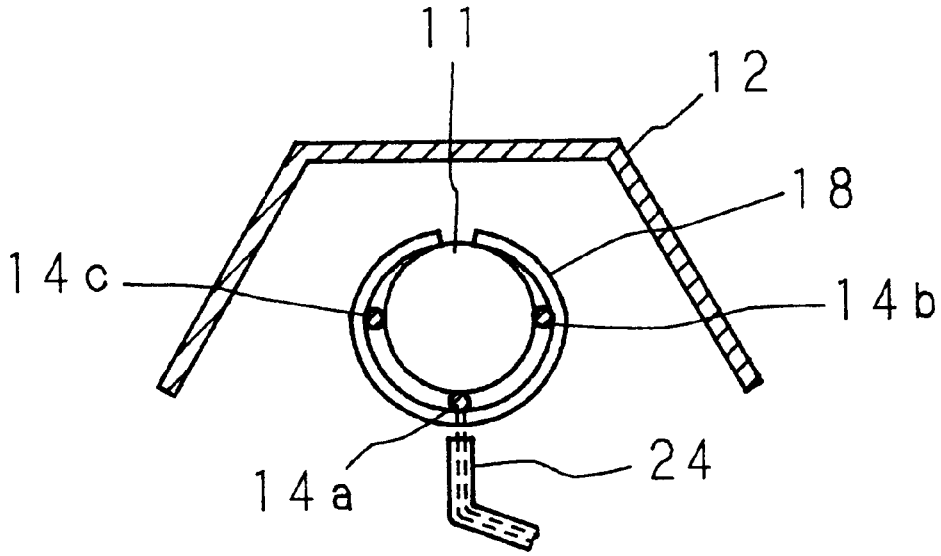
FIG. 4 is a view showing a connected condition of the trigger electrodes and the lead wire.

FIG. 1 is a cross-sectional view showing the outline constitution of a printing device 1 comprising a fixing device 6 of the present invention. FIG. 2 is a cross-sectional view showing the outline constitution of the fixing device 6 of the present invention. FIG. 3 is a perspective view showing a condition of trigger electrodes 14*a*, 14*b* and 14*c* attached to a flash lamp 11. FIG. 4 is a view showing a connected condition between trigger electrodes 14*a*, 14*b* and 14*c* and lead wire 24.

In FIG. 1, the printing device 1 comprises: a body frame 3; a laser exposing device 4 disposed within the body frame 3; and an image forming portion 5 for forming an image through an electrophotographic process by being exposed to a laser exposing device 4.

In the image forming portion 5, an electrostatic latent image is formed on the surface of a photosensitive body 5*a*, through exposure, and toner is bonded to the electrostatic latent image by a developing device 5*b* to form a toner image which is transferred onto a paper P by a transferring device 5*c*. By this process, toner is made to stick on the paper P. When the paper P, in this condition, passes through the fixing device 6, toner sticking on the surface of the paper P is fixed onto the paper P by thermal fusing.

The fixing device 6, as shown in FIGS. 2 and 3, is comprised of: a flash lamp 11; a reflector 12; a glass window 13; trigger electrodes 14*a*, 14*b* and 14*c*; and a supporting frame 15.

As shown in FIG. 3, it has been conventionally known to constitute the flash lamp 11 by attaching main electrodes to both ends thereof and by enclosing a rare gas, such as zenon gas, therein. The flash lamp 11 is pinched and held between a bracket 21, and a tap 22 is attached to the bracket 21 by means of a screw 23. The position of the tap 22 is determined by fixedly attaching the bracket 21 to the supporting frame 15.

The trigger electrodes 14*a*, 14*b* and 14*c* are made of stainless steel and are shaped in the form of a wire with circular sections having a diameter measuring approximately 0.5 to 2 mm. The trigger electrodes are disposed around the periphery of the tube wall of the flash lamp 11 so as to extend along a longitudinal direction. In this embodiment, three trigger electrodes 14*a*, 14*b* and 14*c*, each with a wire diameter of 1 mm, are used.

As shown in FIG. 2, one of the three trigger electrodes 14*a*, 14*b* and 14*c* is disposed at a position at which it is closest to the glass window 13 so as to be a reference trigger electrode 14*a*, and the remaining two electrodes are disposed as auxiliary trigger electrodes 14*b* and 14*c* at lateral positions remote from the reference trigger electrode 14*a* by the same angles in a circumferential direction of the tube wall. If the angular position of the reference trigger electrode 14*a* in a circumferential direction is set as 0°, the angular position of the auxiliary trigger electrode 14*b* is ±90°, and the angular position of the auxiliary trigger electrode 14*c* is −90°. In this specification, the expression "trigger electrodes 14" indicates all or a part of the reference trigger electrode 14*a* and/or auxiliary trigger electrodes 14*b* and 14*c*.

At arbitrary positions in a longitudinal direction of the tube wall of the flash lamp 11, a plurality of supporting rings 17*a* to 17*c* are attached so as to surround the tube wall of the flash lamp 11 and the trigger electrodes 14 in a circumferential direction, whereby the trigger electrodes 14 are held in the above-described constant positions. The supporting rings 17*a*, 17*b* and 17*c* are made of heat resistant insulating material such as ceramic material. By making the supporting rings 17*a*, 17*b* and 17*c* of insulating material, either one of contact of the supporting rings 17*a* to 17*c* with other members, such as the reflector 12, or abnormal electric discharge, can be prevented. If necessary, adhesive may be applied to the contacting portion of the trigger electrodes 14 and the supporting rings 17*a*, 17*b* and 17*c*.

As is shown in FIG. 4, the trigger electrodes 14 are electrically connected to each other at one end in a longitudinal direction thereof by means of a ring-like band 18 made, for instance, of nickel alloy. The lead wire 24, for supplying electricity to the trigger electrodes 14, is connected thereto by means of an adhesive or by means of caulking at a connecting point (i.e., the position at which the band 18 crosses the basic trigger electrode 14*a*). As described later, high voltage, which is opposite in polarity to the electric charge of the toner, is applied to the trigger electrodes 14 through the lead wire 24.

The reflector 12 is provided so as to efficiently reflect light emitted by the flash lamp 11 onto the paper P. The reflector 12 is fixedly attached to the supporting frame 15 and the body frame 3. Thus, the electric potential of the reflector 12 is zero (i.e., ground electric potential). It should be noted that the closest distance between the flash lamp 11 and the reflector 12 is approximately 8 mm.

The glass window 13, with a thickness of approximately 2 mm, is provided to prevent stains on and to protect the flash lamp 11. The glass window 13 is attached to the supporting frame 15 so as to be parallel to the flash lamp 11 and at a distance of approximately 5 mm to 7 mm so as to face the paper P passing through the transporting path at a distance of approximately 8 mm. One example of the size for the opening portion of the glass window 13 is 56 mm wide and 530 mm long.

Though not shown in the drawing figures, a power source device is provided for applying the main electrodes of the flash lamp 11 with a high voltage of approximately 1,700 V at a cycle of approximately 192 ms. A power source device is also provided for applying the trigger electrodes 14 with a high voltage of approximately −20 KV, and with a housing for covering the reflector 12.

Figure 5:
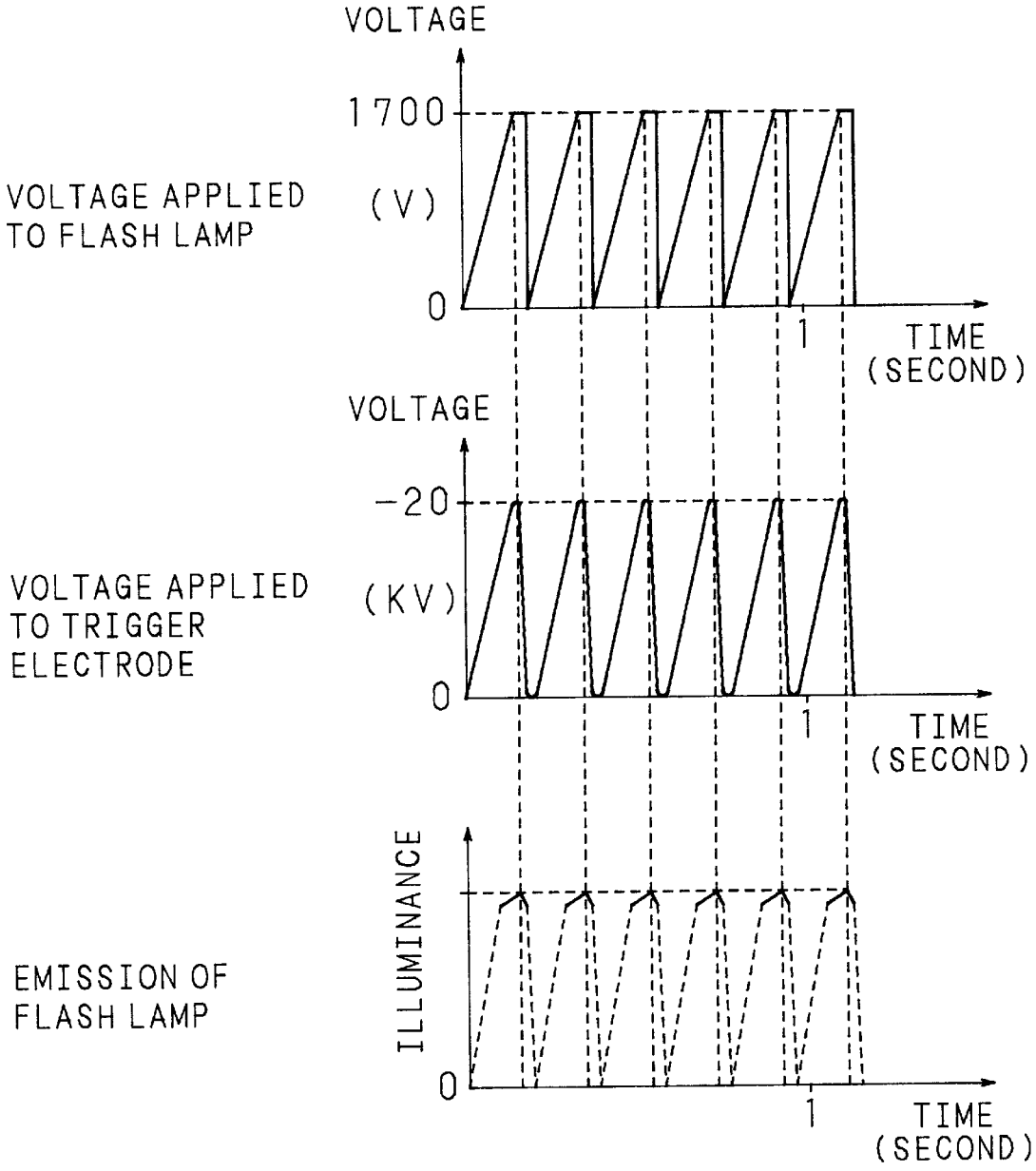
FIG. 5 is a view showing a waveform of voltage applied to the flash lamp.

FIG. 5 is a view showing a waveform applied to the flash lamp 11.

As shown in FIG. 5, the main electrodes of flash lamp 11 are applied with a high voltage of approximately 1,700 V at a maximum at a cycle of 5.2 per second. The trigger electrodes 14 are applied with a high voltage of approximately −20 KV at a maximum synchronously with the voltage applied to the main electrodes. In this embodiment, since the polarity of the electric charge of toner (toner particles) TN is positive, the high voltage applied to the trigger electrodes 14 is opposite in polarity and negative.

Through applying a high voltage to the trigger electrodes 14, an arc discharge occurs between the main electrodes, whereby the flash lamp 11 is made to emit light when the voltage is in the range close to the maximum value.

Figure 6:
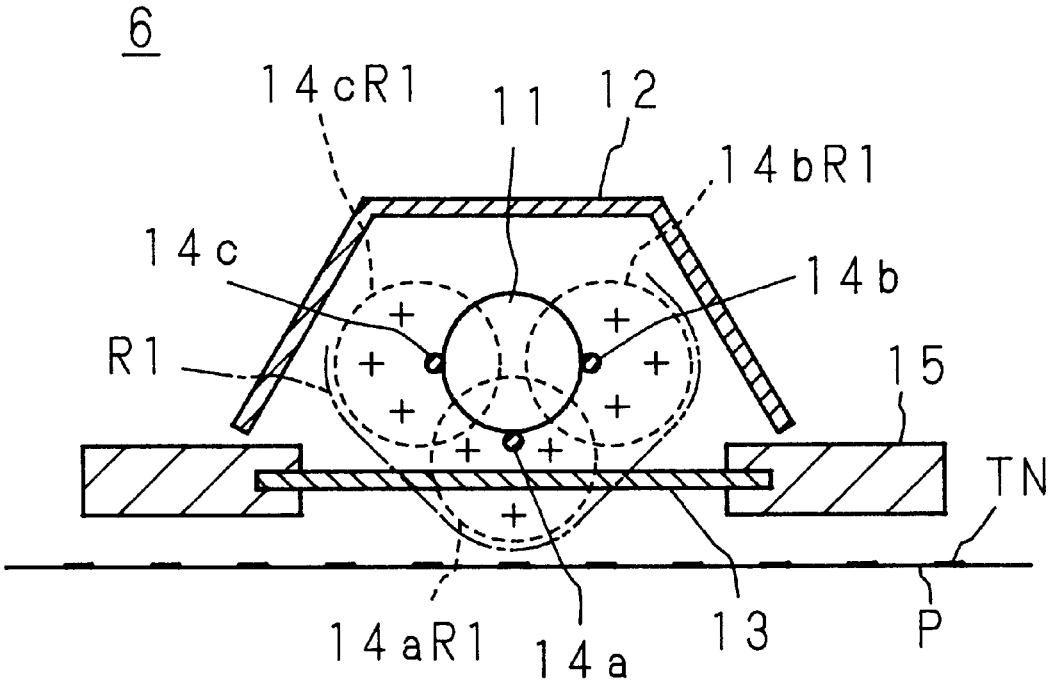
FIG. 6 is a view showing the condition of the ion generated around the trigger electrodes.

Next, the operation of the voltage applied to the trigger electrodes 14 on the toner TN will be explained. FIG. 6 is a view showing the condition of an ion generated around the trigger electrodes 14.

As shown in FIG. 6, an ion charged with an electric charge which is opposite in polarity (positive) to the high voltage supplied (negative) by the positive-ion sheath theory is generated around each trigger electrode 14. In the drawings, ion ranges generated by each trigger electrode 14*a*, 14*b* and 14*c* are shown as 14*a*R1, 14*b*R1 and 14*c*R1, respectively. An envelope R1 of ion ranges 14*a*R1, 14*b*R1 and 14*c*R1 is also shown. The amount of ions generated by high voltage is proportional to the surface area of the trigger electrodes 14. By the generated ion, the glass window 13 and the downward area thereof are positively charged. Further, since three trigger electrodes 14 are disposed at intervals, a broad area downwardly of the glass window 13 is uniformly positively charged. By making the glass window 13 to be positively charged, toner TN, which is positively charged, is repelled, and thus, toner TN is prevented from sticking to the glass window 13.

Figure 7:
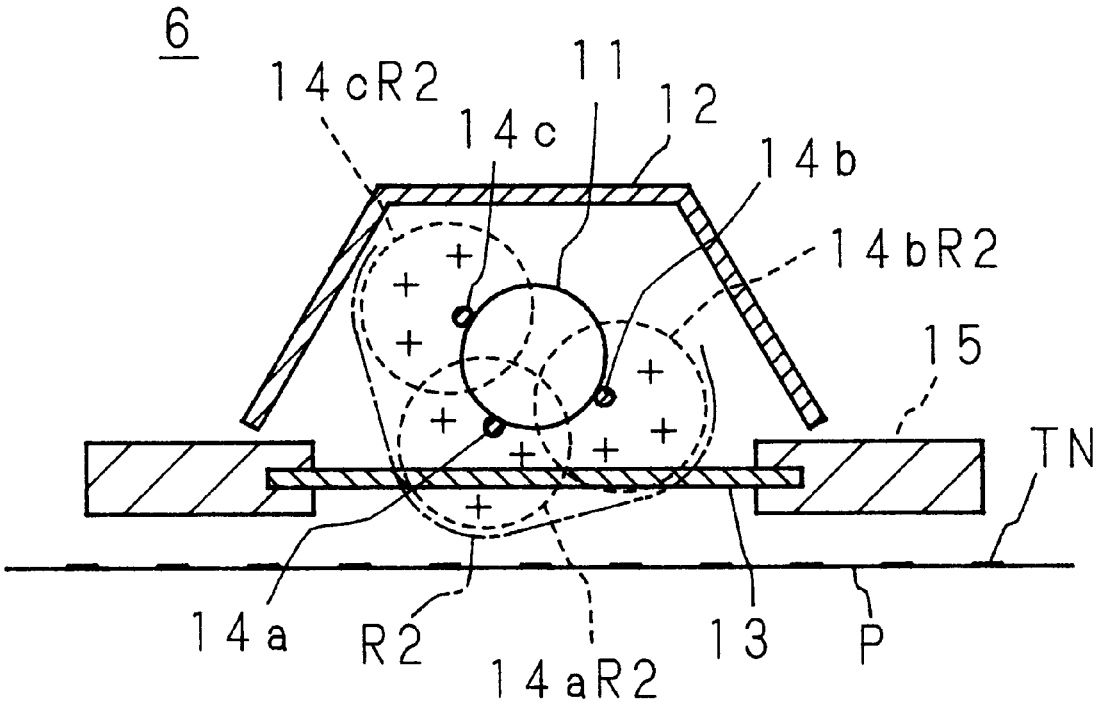
FIG. 7 is a view showing the condition of the ion when the attachment angular position of the flash lamp is shifted.

FIG. 7 is a view showing the ionic condition when the angular position of the attachment of the flash lamp is shifted by deforming the trigger electrodes. Further, FIG. 8 is a view showing the ionic condition in a conventional type fixing device 80 with one trigger electrode, and FIG. 9 is a view showing the ionic condition in a conventional type fixing device 80 with one trigger electrode when the angular position of the attachment of the flash lamp is shifted.

As shown in FIG. 7, the position of the attachment of the reference trigger electrode 14*a* to the flash lamp 11 is different from the position of attachment as described in the above embodiment in that the position of attachment is shifted by a predetermined angle in a circumferential direction from the position at which the flash lamp 11 is closest to the glass window 13. The auxiliary trigger electrodes 14*b* and 14*c* are attached at angles of ±90° with respect to the reference trigger electrode 14*a*. The remaining constitution is equal to that of the above-described fixing device. Thus, corresponding portions are indicated with the same reference numerals and explanation thereof will be omitted here. With this constitution, even if the angular positions of the attachment of the flash lamp 11 and trigger electrodes 14 are shifted, the envelope R2 of areas 14*a*R2, 14*b*R2 and 14*c*R2 covers a broad area of the glass window 13 so that the glass window 13 is uniformly positively charged. By the ion being positively charged, toner TN is repelled so that tone TN can be prevented from sticking to glass window 13.

Figure 8:
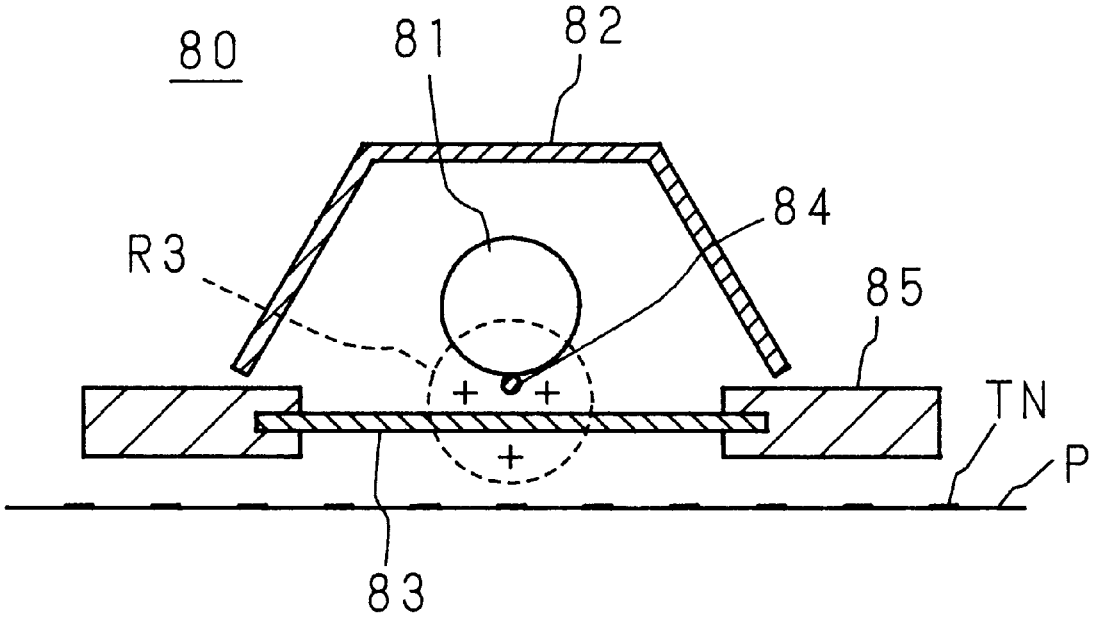
FIG. 8 PRIOR ART
FIG. 8 is a view showing the condition of the ion in a conventional type fixing device with one trigger electrode.
Figure 9:
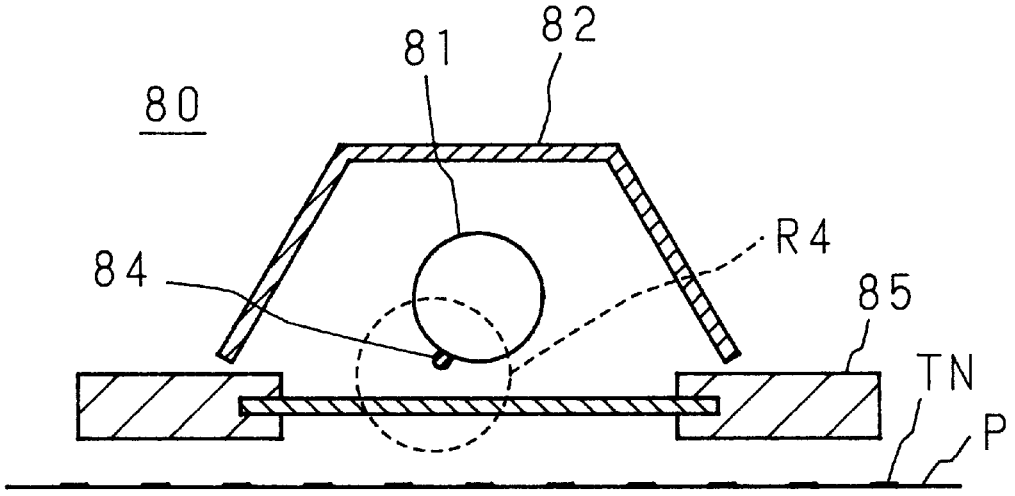
FIG. 9 PRIOR ART
FIG. 9 is a view showing the condition of an ion in a conventional type fixing device with one trigger electrode when the attachment angular position of the flash lamp is shifted.

In contrast, when there is only one trigger electrode as in the conventional device as shown in FIG. 8, the ion range R3, generated around trigger electrode 84, is small. Further, if the angular position of the attachment of the flash lamp 81 is shifted, the ion range R4 generated around the trigger electrode 84 is even smaller as shown in FIG. 9, and toner TN cannot be sufficiently prevented from sticking to the glass window 83. It should be noted that the constitutions shown in FIG. 8 and FIG. 9 are the same as the embodiment of the present invention except for the difference in the arrangement of the trigger electrodes. Thus, corresponding portions are indicated by the same reference numerals and explanations thereof will be omitted here.

In summary, by the provision of the fixing devices 6 of the embodiments according to the present invention, since three trigger electrodes 14 are disposed at intervals, ions generated around the trigger electrodes 14 effect a broad area so that toner TN can be efficiently prevented from sticking to the glass window 13. Moreover, even if the angular position of the attachment of the flash lamp 11 is shifted, or even if the trigger electrodes 14 are deformed after a long term of use, the effect of preventing toner TN from sticking to glass window 13 can be fully exhibited.

Thus, according to the printing device 1 of the embodiment of the present invention, the stain preventing effect of the glass window 13 can be preserved over a long term, and high quality printing is enabled, without the necessity of periodical cleaning of the glass window 13 over a long term.

Further, since the trigger electrodes 14 are disposed at the side where they are closest to the paper P, light emitted from the flash lamp 11 is made strong at the side closer to the paper P, whereby the thermal efficiency of fixing is improved. Since trigger electrodes 14 are supplied with electricity from the connecting point on the reference trigger electrode 14*a*, light emission is made quicker and stronger at the side of the reference trigger electrode 14*a*, whereby the thermal efficiency of fixing is improved.

It should be noted that a substantially multiple number of trigger electrodes may be provided. More particularly, the condition is met if a plurality of trigger electrodes are at the section where they cross the flash lamp 11 in a longitudinal direction, so that, for instance, one long trigger electrode may be bent to run back and forth, which would realize the condition in which a substantially multiple number of trigger electrodes are provided so as to correspond to the number of times the one trigger electrode is bent back and forth.

Figure 10A:
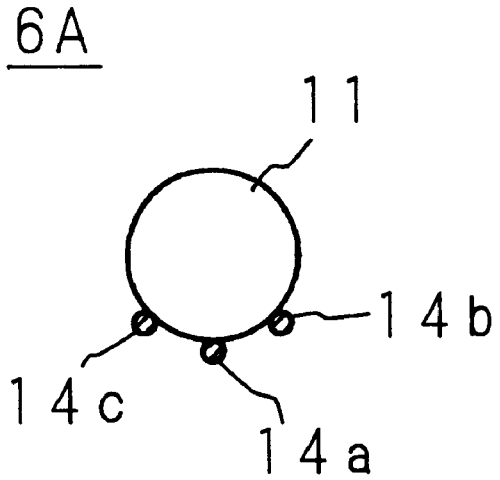
FIGS. 10A and 10B are views showing other embodiments of the number and arrangement of trigger electrodes, respectively.
Figure 10B:
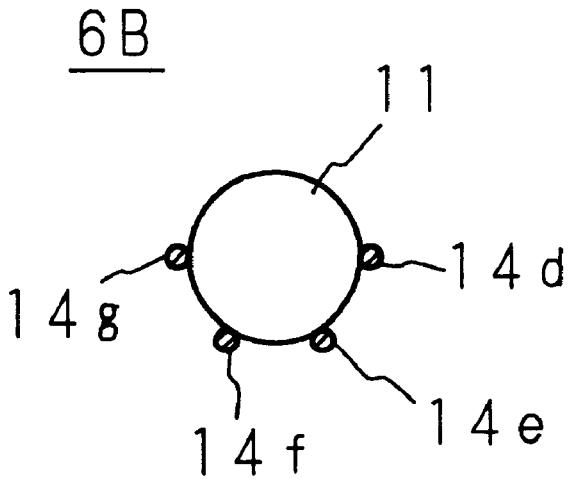

FIG. 10A and FIG. 10B are views showing other embodiments of the number and arrangement of the trigger electrodes 14.

Three trigger electrodes 14 are provided in fixing device 6A of FIG. 10A, but the angular positions of auxiliary trigger electrodes 14*b* and 14*c* are not ±90°. Rather, the angles are smaller. Further, in fixing device 6B of FIG. 10B, four trigger electrodes 14*d* to 14*g* are provided. The angular position of the flash lamp 11, at which the flash lamp 11 is closest to the glass window, is set as 0°, and this position being a reference position, trigger electrodes 14*d* and 14*e* and trigger elements 14*f* and 14*g* are disposed symmetrically to each other, respectively, with respect to the reference position of the flash lamp 11. With this arrangement, the same effect can be obtained as with the fixing device 6 of the above-describe type.

Next, test results supporting the operation and effect of the fixing device 6 will be explained with reference to FIGS. 11A to 11C and FIGS. 12A to 12C.

FIG. 11A is a graph showing the relationship between the number of trigger electrodes 14 and the electric potential at the lower surface of glass window 13 (i.e., glass electric potential).

In this test example, when there is only one trigger electrode 14, the trigger electrode 14 is positioned at the reference position. When there are two trigger electrodes 14, they are positioned symmetrically to each other with respect to the reference position. When there are three trigger electrodes 14, they are arranged, as in the embodiment shown in FIG. 2, at the reference position and at angular positions of ±90°, respectively. When there are four trigger electrodes 14, two trigger electrodes are each positioned symmetrically to each other with respect to the reference position, as shown in FIG. 10B. It should be noted that the value of glass electric potential is an averaged value obtained by measuring multiple spots on the glass window with an electrostatic meter.

According to FIG. 11A, it can be seen that the glass electric potential is increasing with the growth in number of the trigger electrodes 14. For instance, if there are three trigger electrodes 14, the glass electric potential is approximately 1 KV.

FIG. 11B is a graph showing the relationship between angular position of attachment of the flash lamp 11 and the glass electric potential in case of one trigger electrode 14 and in the case of three trigger electrodes 14, respectively. When there is only one trigger electrode 14, it is positioned at the reference position, and when there are three trigger electrodes 14, they are arranged, as in the embodiment as shown in FIG. 2, at the reference position and at angular positions of ±90°, respectively. The same applies now and hereafter.

According to FIG. 11B, when there is only one trigger electrode 14, the glass electric potential may drop to a negative value depending on variations in the angular position, while when there are three trigger electrodes 14, the glass electric potential is maintained at a high positive level even if the angular position varies. It should be noted that in case of one trigger electrode, stains were formed on the glass window 13 when the angular positions were ±10°.

FIG. 11C is a graph showing the relationship between the wire diameter of one trigger electrode 14 and the glass electric potential.

According to FIG. 11C, it can be seen that the greater the wire diameter is, the higher the glass electric potential becomes. Note that in cases where the wire diameter was 0.1 mm, measurement could not be executed since the trigger electrode broke. Some deformation of the trigger electrode 14 occurred when the wire diameter was 1 mm, but not when the wire diameters were 1.6 mm and 2 mm, respectively. Thus, it can be noted that when the wire diameter is 1.6 mm or more, no deformation occurs and is suitable. However, the larger the wire diameter becomes, the more light emitted from the flash lamp 11 is intercepted, so that the wire diameter cannot be made too thick.

FIG. 12A is a graph showing the relationship between the number of pages printed and the fixing rate in case of one trigger electrode 14 and of three trigger electrodes 14, respectively.

According to FIG. 12A, when there is only one trigger electrode 14 and the number of pages printed exceeds 50,000, the fixing rate decreases to less than 80% which is the regulated value for the fixing rate. When the number of pages printed exceeds 170,000, a crack was formed on the glass window 13 due to heat. In contrast, when there were three trigger electrodes, a fixing rate over 90% was ensured even after printing 200,000 pages. Thus, it can be understood that there is no necessity to clean the glass window 13 until the duration of the developer expires (200,000 pages) in the fixing device 6 of the embodiment of the present invention.

FIG. 12B is a graph showing the relationship between the number of pages printed and the fixing rate, wherein cleaning of the glass windows 13 was executed at the time the fixing rate decreased to less than 80% in the case of one trigger electrode 14 and in the case of three trigger electrodes 14, respectively.

According to FIG. 12B, no cleaning of the glass window 13 is necessary up to the time periodical maintenance is executed after printing 300,000 pages when three trigger electrodes 14 are used, but cleaning has to be executed three times in case only on trigger electrode is used.

FIG. 12C is a graph showing the relationship between the number of pages printed and the transmittance of the glass window 13 in the case of one trigger electrode 14 and in the case of three trigger electrodes 14, respectively.

According to FIG. 12C, while the transmittance of the glass window 13 decreases by a large extent when there is only one trigger electrode 14, high transmittance can be maintained in the case of three trigger electrodes 14.

In the above-described embodiments, the number of trigger electrodes 14 has been defined so as to be three or four, but it may also be two or more than five. There may also be two trigger electrodes 14 positioned at the predetermined angular position. If the polarity of the electric charge of toner TN is negative, the trigger electrodes 14 may be impressed with high voltage of positive polarity so that a negative ion is generated.

In the above-described embodiment, tungsten with a gold plated surface may be used as a material for the trigger electrodes 14. With this arrangement, oxidation can be prevented and the duration thereof prolonged. In the present invention, an aluminum board with a mirror-treated surface is used as the reflector 12, but when an aluminum-evaporated, heat resistant glass is used, the reflectabilty can be improved. The constitution, form, material, size or disposition of each portion of the fixing devices 6, 6A, 6B or the printing device 1 may be varied according to the purpose of the present invention.

The present invention enables the preservation of the stain preventing effect of the glass window 13 over along term, and it further enables high quality printing without the necessity of periodical cleaning of the glass window 13 over a long term.

Also, according to the present invention, since the trigger electrodes are supplied with electricity from the connecting point on the reference trigger electrode, the side of the flash lamp tube facing the paper is allowed to quickly and strongly emit light so that good thermal efficiency of fixing can be realized.

Further, according to the present invention, even if the supporting ring is deformed with the passing of time, either one of contact with other members, such as the reflector, or abnormal electricity discharge, can be prevented.

As the present invention may be embodied in several forms without departing from the spirit of the essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

We claim:

1. A fixing device comprising:

a flash lamp tube;

a translucent window, disposed in an opposing position to said flash lamp tube, and at which side opposite to said flash lamp tube, a recording medium having adhering toner thereon passes through:

a plurality of trigger electrodes each disposed around said flash lamp tube and in parallel with a longitudinal direction of said flash lamp tube, wherein said plurality of trigger electrodes include a reference trigger electrode, which is disposed closest to said translucent window, and a plurality of auxiliary trigger electrodes, which are disposed further away from said translucent window than is said reference trigger electrode; and a connecting wire for electrically connecting each trigger electrode of said plurality of trigger electrodes with each other; whereby even upon shifting of the angular positions of the attachment of the flash lamp tube and the plurality of trigger electrodes, a broad area of said translucent window is uniformly charged, which is broader than that which would be charged by a shifted single electrode.

2. The fixing device according to claim 1, wherein said plurality of auxiliary trigger electrodes are disposed on diametrically opposite sides of said flash lamp tube.

3. The fixing device according to claim 1, further comprising a thermally resisting and insulating supporting member for affixing said plurality of trigger electrodes to said flash lamp tube, wherein said supporting member is disposed at a position in said longitudinal direction of said flash lamp tube so as to encircle said flash lamp tube and said plurality of trigger electrodes.

4. The fixing device according to claim 2, wherein said plurality of trigger electrodes is three trigger electrodes so as to include said reference trigger electrode and two auxiliary trigger electrodes, and each auxiliary trigger electrode of said two auxiliary trigger electrodes are disposed at angles of substantially ±90° with respect to said reference trigger electrode.

5. The fixing device according to claim 2, further comprising a trigger lead wire for supplying electricity to each trigger electrode of said plurality of trigger electrodes, wherein said trigger lead wire is connected to a connecting point between said reference trigger electrode and said connecting wire.

6. The fixing device according to claim 2, further comprising a thermally resisting and insulating supporting member for affixing said plurality of trigger electrodes to said flash lamp tube, wherein said supporting member is disposed at a position in a longitudinal direction of said flash lamp tube so as to encircle said flash lamp tube and said plurality of trigger electrodes.

7. The fixing device according to claim 3, wherein said plurality of trigger electrodes is three trigger electrodes so as to include said reference trigger electrode and two auxiliary trigger electrodes, and each auxiliary trigger electrode of said two auxiliary trigger electrodes are disposed at angles of substantially ±90° with respect to said reference trigger electrode.

8. The fixing device according to claim 3, further comprising a trigger lead wire for supplying electricity to said plurality of trigger electrodes, wherein said trigger lead wire is connected to a connecting point between said reference trigger electrode and said connecting wire.

9. The fixing device according to claim 4, further comprising a trigger lead wire for supplying electricity to said plurality of trigger electrodes, wherein said trigger lead wire is connected to a connecting point between said reference trigger electrode and said connecting wire.

10. The fixing device according to claim 1, further comprising a supporting frame in which said translucent window is embedded.

11. The fixing device according to claim 1, further comprising a plurality of ion ranges, wherein each ion range of said plurality of ion ranges surrounds any one of said reference trigger electrode and said plurality of auxiliary trigger electrodes.

12. The fixing device according to claim 11, further comprising an envelope enclosing each ion range of said plurality of ion ranges so that an outer periphery of said envelope passes through said translucent window.

13. The fixing device according to claim 3, wherein said thermally resisting and insulating supporting member for affixing said plurality of trigger electrodes to said flash lamp tube are supporting rings.

14. The fixing device according to claim 1, further comprising a reflector located on an opposite side of said flash lamp tube from said translucent window.

15. The fixing device according to claim 4, wherein said plurality of trigger electrodes includes four trigger electrodes.

16. A fixing device comprising:

a flash lamp tube;

a translucent window, disposed in an opposing position to said flash lamp tube, and at which side opposite to said flash lamp tube, a recording medium having adhering toner thereon, passes through;

a plurality of trigger electrodes each disposed around said flash lamp tube and in parallel with a longitudinal direction of said flash lamp tube, wherein said plurality of trigger electrodes includes four trigger electrodes; and a connecting wire for electrically connecting each trigger electrode of said plurality of trigger electrodes with each other; whereby even upon shifting of the angular positions of the attachment of the flash lamp tube and the plurality of trigger electrodes, a broad area of said translucent window is uniformly charged, which is larger than that which would be charged by a shifted single electrode.

17. The fixing device according to claim 16, further comprising a thermally resisting and insulating supporting member for affixing said plurality of trigger electrodes to said flash lamp tube, wherein said supporting member is disposed at a predetermined position in said longitudinal direction of said flash lamp tube so as to encircle said flash lamp tube and said plurality of trigger electrodes.

* * * * *